US005370510A

United States Patent [19]

Sinclair et al.

[11] Patent Number: 5,370,510

[45] Date of Patent: Dec. 6, 1994

[54] LIQUID METERING SYSTEM

[75] Inventors: Michael A. Sinclair, Crown Point; Patrick S. Mitchell, Griffith, both of Ind.

[73] Assignee: Bee Chemical Company, Lansing, Ill.

[21] Appl. No.: 147,107

[22] Filed: Nov. 3, 1993

Related U.S. Application Data

[63] Continuation of Ser. No. 897,728, Jun. 12, 1992, abandoned.

[51] Int. Cl.[5] ..... F08B 43/08

[52] U.S. Cl. ..... 417/477.9; 417/477.14

[58] Field of Search ..... 417/477 H, 477 J, 477 M, 417/474

[56] References Cited

U.S. PATENT DOCUMENTS

| | | | |
|---|---|---|---|
| 2,123,781 | 7/1938 | Huber . | |
| 2,466,618 | 4/1949 | Stocks | 417/477 |
| 3,101,674 | 8/1963 | Weiskopf . | |
| 3,523,000 | 8/1970 | Miller | 417/477 |
| 3,582,234 | 6/1971 | Isreeli | 417/53 |
| 3,712,762 | 1/1973 | Kenney | 417/477 |
| 3,758,239 | 9/1973 | Hrdina | 417/477 |
| 3,768,934 | 10/1973 | Magerle | 417/477 |
| 4,529,106 | 7/1985 | Broadfoot et al. | 222/207 |
| 5,024,347 | 6/1991 | Baldwin | 222/1 |

FOREIGN PATENT DOCUMENTS

| | | | |
|---|---|---|---|
| 6332178 | 2/1978 | Japan | 417/477 |

*Primary Examiner*—Richard E. Gluck

*Attorney, Agent, or Firm*—Mark F. LaMarre; Gerald K. White

[57] ABSTRACT

A pump device for metering and/or feeding liquid materials, particularly colorants and plasticizers for molded plastics. The pump consists of a linear metering tube which is straight throughout of length of the compression zone, thereby reducing stress and fatigue on the tube, thus prolonging tube life. The metering tube is compressed by compression rollers attached to an endless drive belt which moves within a track cut into a housing. In another embodiment of this invention, wherein the linear metering tube is inclined slightly, stresses on the tube are distributed over the tube by the gradual compression of the tube. The pump provides for simple, precise, long-life dispensing of polymer additives.

5 Claims, 4 Drawing Sheets

LIQUID METERING SYSTEM

This is a continuation of co-pending application Ser. No. 07/897,728 filed on Jun. 12, 1992, now abandoned.

BACKGROUND OF THE INVENTION

1. Field of the Invention

This invention relates generally to apparatus for metering and/or feeding fluid material, particularly colorants and plasticizers for injection molded/extruded polymers. More particularly, this invention relates to compressible tube type pumps or peristaltic metering pumps as they are more commonly known and improvements in extending tube life.

2. Description of Related Art

Conventionally, rotary peristaltic pumps have heretofore utilized curvilinear metering tubes as described in U.S. Pat. No. 2,123,781. Also, described in U.S. Pat. Nos. 3,101,674 and 3,582,234 are liquid metering tubes which are in part linear, but which have bends or curves in the metering tube within the zone which is compressed in order to transport the metered liquid. The non-linearity or the bending of the metering tube increases the stress on the tube resulting in premature failure. Premature failure of the metering tube is of concern due to the potential loss of material and the possible damage to equipment. This is especially important in the polymer colorant and plasticizer area due the high cost of the material.

Stress on the metering tube is believed to be concentrated at the sharpest point of the bend of the metering tube over which the compression rollers pass. This is believed to be due to the stretching of that section of the tube which is toward the outside of the bend and the compression of that section of the tube which is toward the inside of the bend during compression of the tubing. The repeated stretching of the outside of the metering tube which is under tension is believed to cause the failure of the metering tube at the location of the bend.

U.S. Pat. No. 4,529,106, discloses a metering and feeding unit for fluid materials, such as Gunite, a sand cement mixture. A vertically oriented elastic-walled tube is collapsed by tube means for engaging a portion of the tube wall to collapse the tube against itself. The pumping action of the rollers travelling over the length of the tube assists the normal flow of material due to gravity. A valve is provided to allow entry of the fluid material into the feed end of the tube at periodic intervals. The valve works in coordination with a power-driven assembly so that when the tube is initially engaged to collapse it, that portion of the tube is substantially free of material.

SUMMARY OF THE INVENTION

An object of this invention is provide a means to reduce the stresses on the metering tube of a peristaltic pump Another object of this invention is provide a means to reduce the mechanical fatigue on the metering tube of a peristaltic pump.

Another object of this invention is to provide a means to prolong the working life of the metering tube of a peristaltic pump.

Another object of this invention is to provide a means of continuous flow of metered material over extended periods of time.

These and other objectives of the invention, which will become apparent from the following description, have been achieved by the use of a substantially linear metering tube which is linear for the entire length of the compression zone of the tube.

The pump of this invention comprises a housing, with a track which forms a loop cut into the housing. A substantially flat plate, having a first end and second end, is cut into the housing. The support plate forms part of the track. A retainer bracket is attached to the housing within the track. Also, included is an open-ended, elastic-walled hollow tube for receiving material, the tube having an open feed end, an open discharge end, an inside wall, an outside wall, a top edge, and a bottom edge. Included additionally are a power-driven assembly positioned adjacent the length of the tube with spaced compression rollers mounted on an endless, flexible, drive belt. The endless belt with the attached compression rollers travel within the track. The spaced compression rollers which, in repeating cycles, engage the metering tube at a first contact point to collapse a portion of the metering tube between the compression rollers and the support plate starting near the feed end of the tube and working progressively toward the discharge end where it disengages the tube at a second contact point of the tube and discharges the material from the tube. At least one edge of the tube is straight for at least a portion thereof between the feed end adjacent the first contact point and the first contact point, and between the first contact point and the second contact point. Also, a portion of the metering tube can be straight between the second contact point and the discharge end adjacent to the second discharge point. The retainer bracket acts as a support for the endless flexible drive belt to counteract the force exerted by the metering tube as it is compressed by the compression rollers. A further embodiment of this invention includes a support plate which is inclined between from about 1° to about 9°.

BRIEF DESCRIPTION OF THE DRAWINGS

With this description of the invention, a detailed description follows with reference being made to the accompanying figures of drawing which form part of the specification, in which like parts are designated by the same reference numbers, and of which.

DETAILED DESCRIPTION OF THE INVENTION

Figure 1:
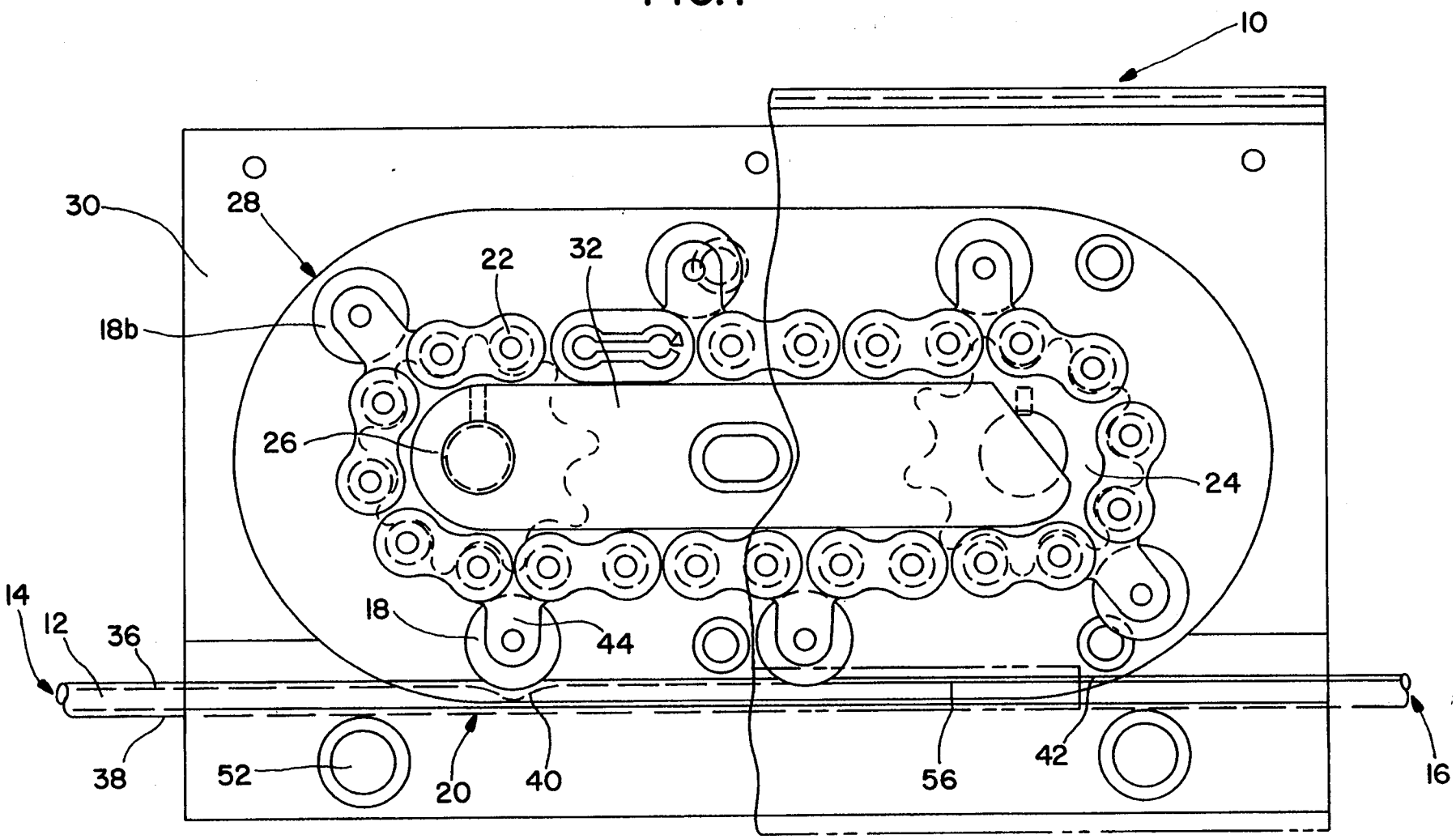
FIG. 1 is a front fragmented plan view of the pump illustrating the pump mechanism, with a cover plate partially removed for clarity.

As best seen in FIG. 1, a pump head assembly shown generally at 10 is provided for effecting the pumping of a liquid, preferably a plasticizer, polymer colorant, or the like through a compressible metering tube 12 having an inlet 14 and an outlet 16. The compressible metering tube 12 which is compressed between compression rollers 18 and a substantially flat support plate 20. The compression rollers 18 are attached to an endless belt 22 driven by a drive sprocket 24 and supported by an idler sprocket 26. The drive sprocket 24 can be driven by an electrical motor (not shown).

Figure 2:
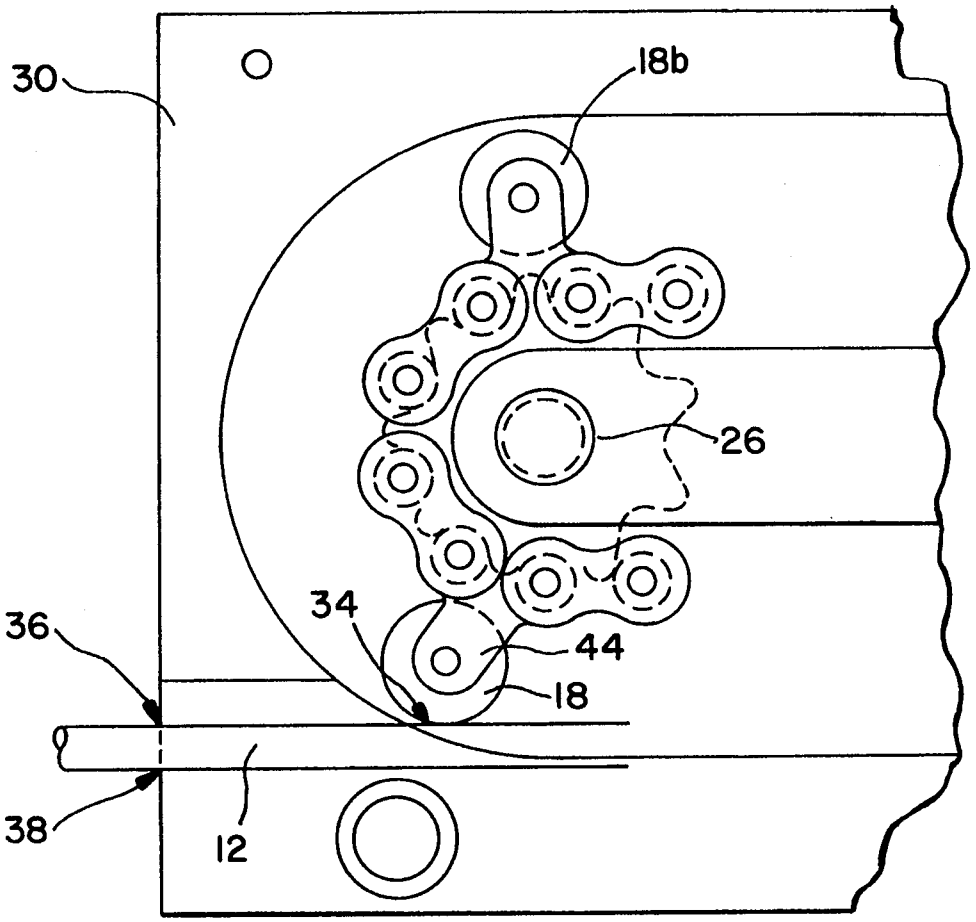
FIG. 2 is a detailed view of FIG. 1 illustrating engagement of the metering tube by the compression roller at the first contact point.
Figure 3:
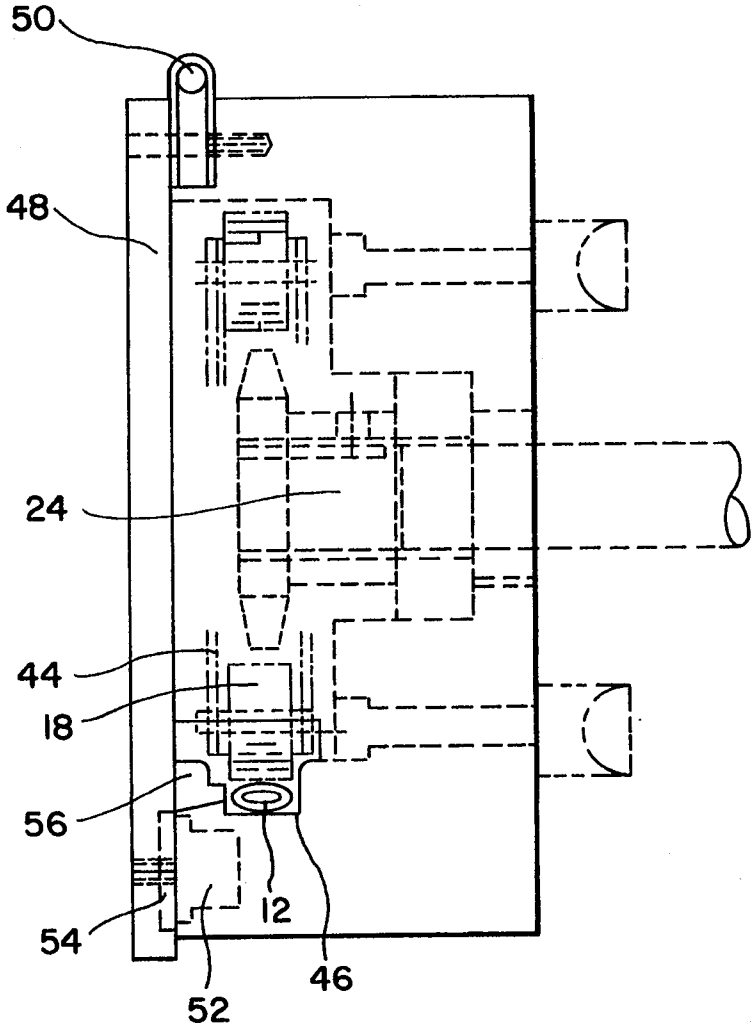
FIG. 3 is a side plan view of the pump illustrating the pump mechanism.

The compression rollers 18 attached to the endless belt 22 move within a track 28 cut in to a housing 30. The housing 30 prevents external interference in the motion of the endless belt 22 during operation of the pump. A retainer bracket 32 is attached to the housing 30 to contain the endless belt 22 to prevent it from become dislodged from the drive sprocket 24 or idler sprocket 26 and to maintain tension on the endless belt 22 between the drive wheel 24 and the idler wheel 26. The retainer bracket 32 also acts as a support against which the endless belt 22 is pressed when the compression rollers 18 applies pressure to the compressible metering tube. The compression rollers 18 engage the metering tube 12 at a first contact point 34, as shown in FIG. 2. The metering tube 12 is then compressed so that the upper inner wall 36 of the metering tube 12 and the lower inner wall 38 are brought into contact with one another to form a barrier 40. At which point the compressible metering tube is completely compressed. As the compression roller 18 continues to move, driven by the endless belt 22, the fluid trapped in front of the barrier 40 is pushed through the metering tube 12 toward the metering tube outlet 16 as the barrier 40 is moved along the metering tube 12. This action also creates a vacuum which draws material in to the inlet 14 in preparation for the next compression roller **18*b*. This cycle is repeated by second compression roller 18*b* in the same manner as the first compression roller 18. The compression roller 18 continues to travel along the metering tube 12 moving the barrier 40 along until the compression roller disengages from the metering tube 12 at a second contact point 42. This section of the compressible metering tube 12 between the first contact point 34 and the second contact point 42 is referred to as the compression zone. The metering tube 12 of this invention must be substantially linear for at least a portion thereof between said feed end 14 adjacent said first contact point 34 and said first contact point 34, and between said first contact 34 point and said second contact point 42. This embodiment of the invention permits operation of the pump in either forward or reverse, therefore the inlet 14 and the outlet 16** can be reversed.

Figure 4:
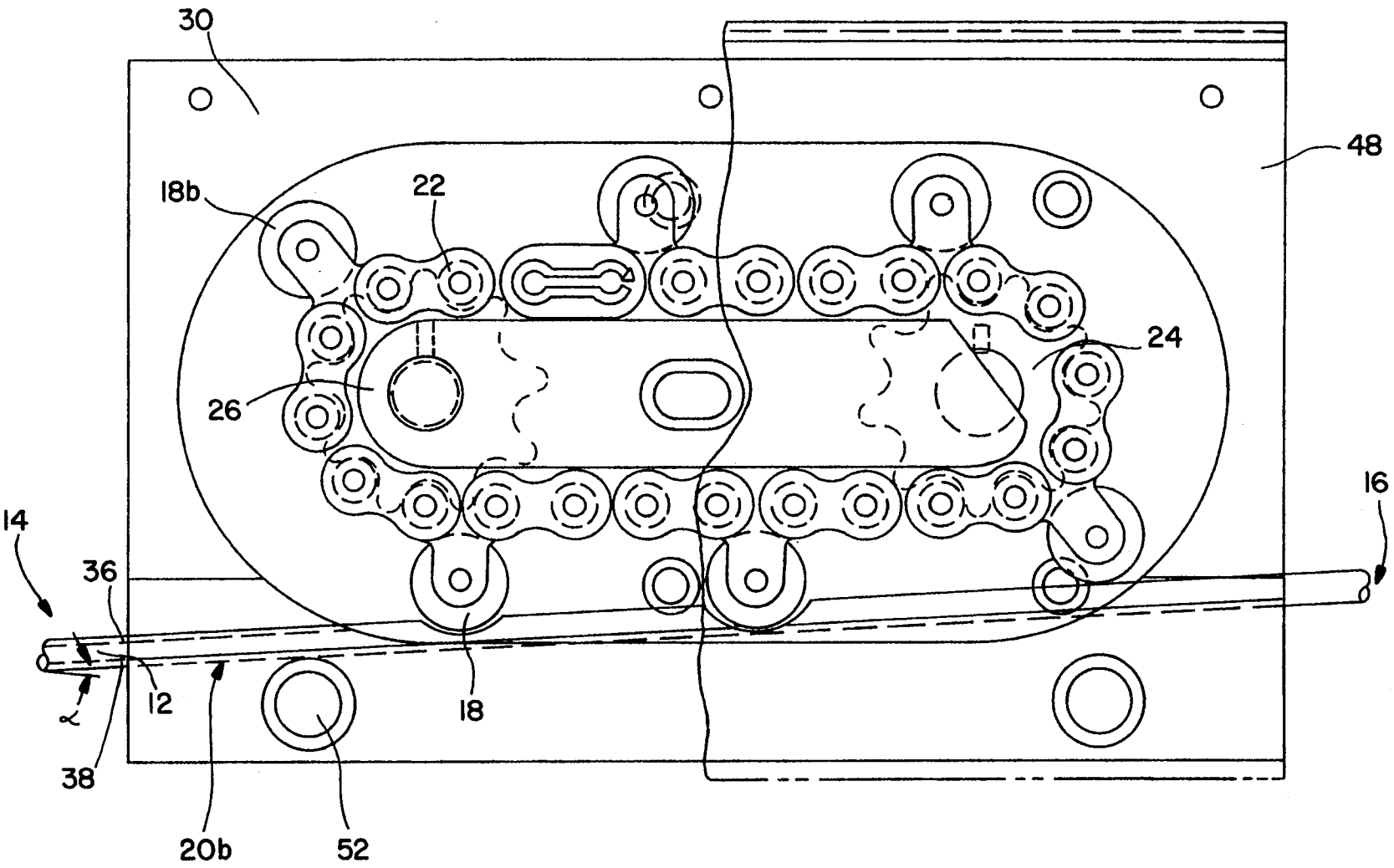
FIG. 4 is a front plan view of the pump illustrating the pump mechanism with an inclined support plate.

Another embodiment of this invention is shown in FIG. 4 wherein the support plate **20*b* is inclined from about 1° to about 9° and more preferably from about 4° to about 6°. This is believed to distribute the stresses on the compressible metering tube 12 by physically separating the first contact point 34 and the first point of complete compression of the tube. The compression of the compressible metering tube 12 in this embodiment of the invention occurs gradually over a portion of the compressible metering tube 12**.

The compressible metering tube 12 is made from any suitably elastic and inert material of appropriate strength for example, silicon rubber, polyethylene, polypropylene, polyurethane, Norprene®, Tygon®, Vitron®, or the like. The compressible metering tube 12 is of narrow diameter, and is determined by the material being pumped and the volumetric flow rate required. Normally the metering tube 12 diameter is from about $\frac{1}{8}$ inches (0.318 cm) to about $\frac{1}{4}$ inches (0.635 cm) for plasticizers and colorants used in the polymer processing industry.

The endless belt 22 can be made from any suitable flexible non-elastic material. Preferably the belt is made from chain similar to conventional bicycle chain due to the flexibility requirements in conjunction with strength and minimal stretching required to provide for rapid and continuous compression of the compressible metering tube 12. The compression rollers 18 are made from a suitable polymeric material. The compression rollers 18 are attached to the endless belt 22 by metal attachment brackets 44. Roller chain of this type can be obtained from Tsubakimoto Chain Company of Japan.

The housing 30, which acts to support the pump assembly, and provides a track 28 for the compression rollers 18 can be made out of any suitable material, for example, but not limited to metal or any one of a number of engineering plastics, such as Devron®. The use of engineering plastics is preferred due to lighter weight and ease of manufacturing. The housing 30, support plate 20, and track 28 can all be formed from one piece of material. The support plate 20 can be recessed to form a channel 46 through which the compressible metering tube 12 is inserted. The channel 46 assists in loading the compressible metering tube 12 into the pump assembly.

The retainer bracket 32 of this invention can be made from any hard resilient material. Preferably the retainer bracket is made from steel. It is also preferred to heat treat the steel to harden it in order that it is more resistant to abrasion. This is particularly important for that part of the retainer bracket which is opposite the compressible metering tube 12. This section of the retainer bracket is abraded quite rapidly due to the combination of the movement of the endless drive belt across the surface of the bottom surface of the retainer bracket 32 and the force applied by the metering tube as it resists compression. The retainer bracket 32 is attached to the housing 30 by conventional means.

The pump assembly is covered by a hinged cover plate 48 attached to the housing 30 with hinges 50 and held into place by magnets 52 inserted into the housing 30 and steel disks 54 attached to the cover plate 48. The cover plate 48 can be made from any suitable clear polymeric material to permit the observation of the pump during operation. A retention bar 56 is attached to the cover plate 48 opposite the compressible metering tube 12 to hold the compressible metering tube in place during operation of the pump.

Thus, in accordance with the invention, there has been provided a means to reduce the stresses on the metering tube of a peristaltic pump. There has also been provided a means to reduce the mechanical fatigue on the metering tube of a peristaltic pump. There has also been provided a means to prolong the working life of the metering tube of a peristaltic pump. Additionally, there has been provided a means of continuous flow of metered material over extended periods of time.

With this description of the invention in detail, those skilled in the art will appreciate that modification may be made to the invention without departing from the spirit thereof. Therefore, it is not intended that the scope of the invention be limited to the specific embodiments that have been illustrated and described. Rather, it is intended that the scope to the invention be determined by the scope of the appended claims.

We claim:

1. A pump for liquid material comprising:

a housing;

a track cut into said housing, wherein said track forms a loop;

a support plate cut into said housing, said support plate having a first end and second end, said support plate is inclined over the entire length from said first end to said second end, wherein said incline is at a fixed angle of from about 1° to about 9°;

a channel formed into said support plate;

a retainer bracket attached to said housing within said track and having a top edge, a bottom edge, a front surface, and a back surface;

an open-ended, elastic-walled hollow tube for receiving liquid material, held in said channel formed into said support plate and supported by said support plate, said tube having an open feed end and an open discharge end; and a power-driven assembly positioned adjacent the length of said tube comprising, a power-driven drive wheel, a free-moving wheel, spaced compression rollers mounted on an endless, flexible drive belt traveling within said track wherein said flexible drive belt passes around the outside of said drive wheel and said free-moving wheel and is engaged by said wheels such that movement of said drive wheel will move said flexible drive belt; said angle taken with respect to said belt at a location adjacent said support plate; said compression rollers which, in repeating cycles, engage said tube at a first contact point to gradually collapse a portion of the tube between said compression roller and said support plate starting at said first contact point of said tube and working progressively toward the discharge end where it disengages said tube at a second contact point of said tube and discharges the material from the tube, wherein at least one edge of said tube is inclined at the same angle as the support plate for at least a portion thereof between said feed end, adjacent said first contact point, and said first contact point, and between said first contact point and said second contact point, and between said first contact point and said second contact point, and wherein said retainer bracket provides support for said drive belt engaging said tube.

2. A pump of claim 1 wherein at least one edge of said tube is inclined at the same angle as the support plate for at least a portion thereof between adjacent said second contact point and said discharge end of said tube.

3. The pump of claim 1 wherein said power driven wheel is a sprocket.

4. The pump of claim 1 wherein said free-moving wheel is a sprocket.

5. The pump of claim 1 wherein said support plate is inclined from about 4° to about 6°.

* * * * *